US005515560A

United States Patent [19]

Strobel

[11] Patent Number: 5,515,560

[45] Date of Patent: May 14, 1996

[54] WATERBED WITH INTEGRAL FRAME AND SAFETY LINER

[76] Inventor: Mark J. Strobel, 3131 Industrial Pkwy., Jeffersonville, Ind. 47130

[21] Appl. No.: 359,834

[22] Filed: Dec. 20, 1994

[51] Int. Cl.[6] ..... A47C 27/08

[52] U.S. Cl. ..... 5/451; 5/932

[58] Field of Search ..... 5/451, 452, 400, 5/481, 449, 450, 474, 932

[56] References Cited

U.S. PATENT DOCUMENTS

| | | | |
|---|---|---|---|
| 3,735,432 | 5/1973 | Kreten et al. | 5/451 |
| 4,193,151 | 3/1980 | Calleance | 5/452 |
| 4,352,217 | 10/1982 | O'Rourke | 5/451 |
| 4,637,082 | 1/1987 | Moore et al. | 5/452 |
| 4,713,852 | 12/1987 | Fox, Sr. et al. | 5/451 |

*Primary Examiner*—Alexander Grosz
*Attorney, Agent, or Firm*—James B. Middleton

[57] ABSTRACT

A frame for a soft sided waterbed has four rails of foam covered with vinyl or other water impervious sheet. The cover sheet extends completely around each foam rail, and a central portion extends across the frame to the opposite foam rail. A reinforcing sheet can be coextensive with the central portion if needed. The cover sheet is then sealed to itself at each foam rail, so the frame defines a waterproof safety liner integrally therewith. The cover sheet may have holes in each corner, on the bottom of the frame, so the foam rails can be removed and reinserted. This allows the frame to be shipped in "knocked-down" condition and assembled by the user.

2 Claims, 1 Drawing Sheet

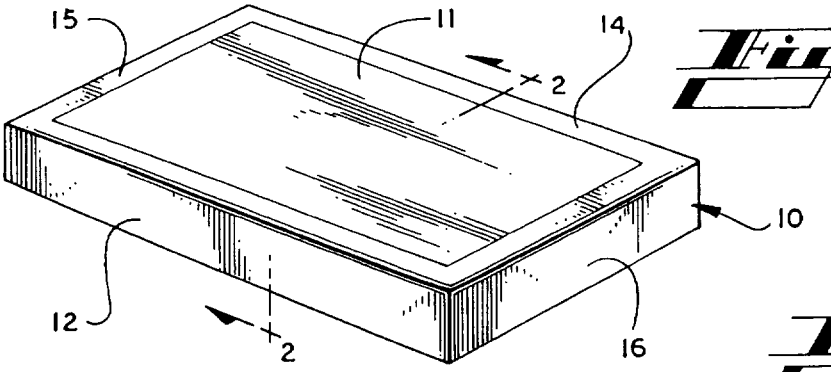
Fig_1
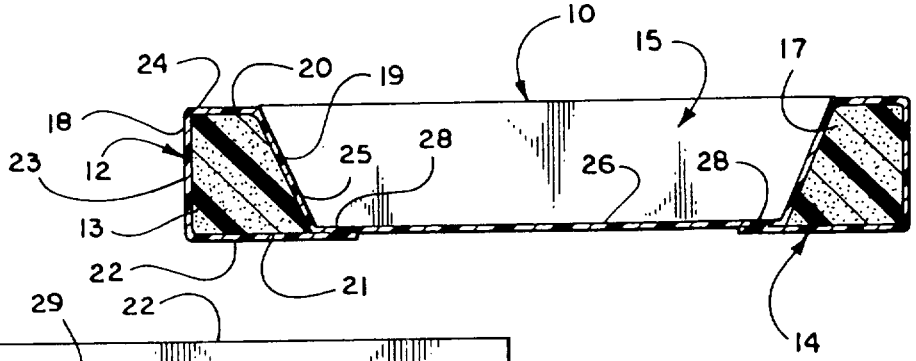
Fig_2
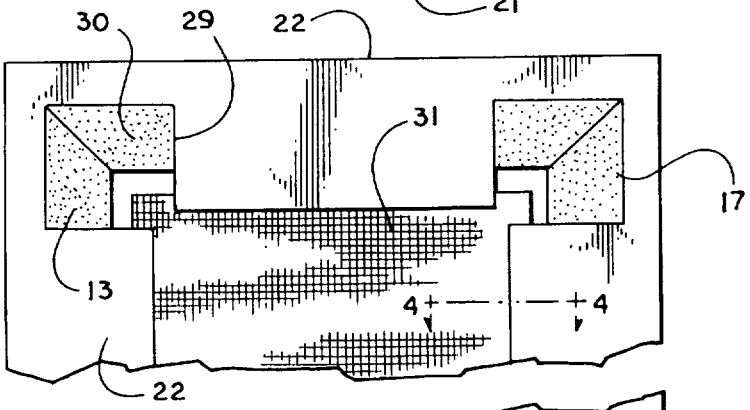
Fig_3
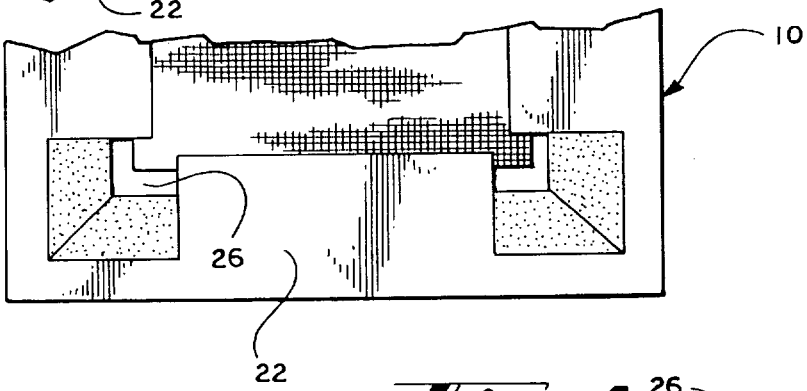
Fig_4
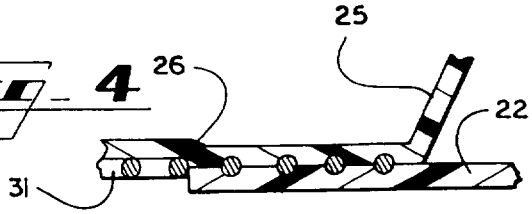

WATERBED WITH INTEGRAL FRAME AND SAFETY LINER

BACKGROUND OF THE INVENTION

1. Field of the Invention

This invention relates generally to frames for waterbeds, and is more particularly concerned with a frame for a soft sided waterbed having a safety liner integral therewith.

2. Discussion of the Prior Art

A conventional soft sided waterbed includes a plurality of foam rails placed to form a rectangle enclosing a waterbed mattress. The foam rails are generally covered by a fabric, either woven or non-woven; and, a piece of fabric extends between opposite rails in order to hold the rails together. Typically, the corners of the individual rails are unattached. The fabric that extends between the opposite rails must have sufficient strength to hold the rails in their proper spaced positions, overcoming the outward pressure exerted by the waterbed mattress which exerts outward forces.

To complete a waterbed, the above described frame is placed on a deck; then, a safety liner covers the entire frame. The safety liner is water impervious as a safety measure in the event of a leaking mattress.

There are numerous variations in the specific arrangement for holding the foam rails in their proper relative positions, but all the prior art waterbeds require the additional safety liner covering the entire frame and receiving the mattress therein.

SUMMARY OF THE INVENTION

The present invention provides a soft sided waterbed frame including four rails placed relative to one another to form a rectangular frame, and a single cover sheet covers all the foam rails and extends between the foam rails to hold the rails in proper spaced positions. The cover sheet is made of a water impervious material, such as a vinyl sheet so the cover sheet also serves as a safety liner, and the mattress of the present invention does not require an additional safety liner.

In one embodiment of the invention the cover sheet may be sealed around the four foam rails so the entire frame is permanently formed. In another embodiment of the invention, the cover sheet can be separately formed, and holes can be provided at each corner, so the foam rails can be subsequently inserted. The latter arrangement allows the frame to be shipped in a knocked-down condition for greater compactness in shipping.

BRIEF DESCRIPTION OF THE DRAWINGS

These and other features and advantages of the present invention will become apparent from consideration of the following specification when taken in conjunction with the accompanying drawings in which:

FIG. 1 is a perspective view of a waterbed mattress having a frame made in accordance with the present invention;

FIG. 2 is an enlarged cross-sectional view taken along the line 2—2 in FIG. 1, but with the mattress omitted for clarity;

FIG. 3 is a bottom plan view, partially broken away, showing a waterbed frame made in accordance with the present invention; and, FIG. 4 is a highly enlarged fragmentary cross-sectional view taken along the line 4—4 in FIG. 3.

DETAILED DESCRIPTION OF THE EMBODIMENT

Referring now more particularly to the drawings, and to that embodiment of the invention here presented by way of illustration, FIG. 1 shows a frame generally designated at 10, and having a mattress 11 therein. The frame 10 is made up of a pair of side rails 12 and 14, and head and foot rails 15 and 16. As is conventional, all the rails 12–16 include a flat upper surface, and a generally vertical outer surface.

The shape of the rails 12–16 is shown better in FIG. 2 of the drawings, and the covering is also shown in FIG. 2. First, it will be seen that the rails are generally trapezoidally shaped, with the vertical outside surface 18 and an inwardly sloping inner surface 19. The top surface 20 is relatively short, and the bottom surface 21 is relatively long. All four of the rails are shaped the same, so the description will not be repeated, and the same reference numerals will be used.

There is a cover sheet covering the rails 12–16, and extending between the opposed rails. As is shown in FIG. 2, the cover sheet begins beneath the foam member 13 of the rail 12, the portion 22 extending under the member 17. The cover sheet then extends up with portion 23, across the top with portion 24, and down the inside with portion 25. The cover sheet then extends across the frame with the central portion 26, and around the foam member 17 of the rail 14. The wrapping of the rail 14 is the same as the wrapping of the rail 12, and the details will not be repeated. It is important to notice that the beginning and ending portions 22 of the cover sheet are fixed to the central portion 26 as indicated at 28.

Those skilled in the art will realize that, to cause the cover sheet to conform to the frame 10 as shown, the vinyl or other material must be shaped to fit the frame. It is preferable to fabricate the shape by cutting the corners of a flat sheet, and heat-sealing the corners to fit the three-dimensional shape. Such fabrication is well within the skill of the ordinary artisan, so the details are not included here, and the seams are not indicated. It is also possible to vacuum form the flat vinyl sheet to achieve the same result. The mold for vacuum forming would be quite large, and one would have to start with a thick sheet to end with a sheet thick enough for the required strength. Thus, the fabrication is preferred to the forming technique, but either may be used.

Those skilled in the art will realize that the frame shown in FIG. 2 of the drawings looks very similar to a conventional frame; however, the conventional frame would have fabric coverings around the foam members 13 and 17 of the rails 12 and 14. Generally, an additional piece of fabric will then be fixed to the two rails and extend between the two rails. With that construction, one must then place a safety liner over the entire frame to contain water in the event the mattress leaks. The frame of the present invention, on the other hand, utilizes an integral piece of vinyl or other water impervious material to surround the opposed foam members, and to extend between the frame members. As a result, the same material that creates the rails of the frame constitutes a safety liner for the frame, obviating the need for an additional liner.

As discussed in connection with FIG. 2, it is contemplated that the foam members 13 and 17 (and similar foam members in the head and foot rails) will have the cover sheet pulled tightly around them, and the cover sheet will then be sealed to itself at 28 to create an integral frame. A variation of this technique is illustrated in FIG. 3.

FIG. 3 shows the bottom of a frame such as that illustrated in FIGS. 1 and 2, and there are openings in corners, in the bottom of the frame. For example, the opening 29 at the upper left of the figure is generally in the corner and is large enough to reveal the foam member 13 and the foam member 30 for the head rail 15. The other openings are similarly placed, and each reveals the ends of two adjacent foam members. It will of course be understood that the holes, such as the hole 30, would be included in the initial laying out of the cover sheet, though one might cut the openings later if preferred.

With the openings such as the opening 29, it can be seen that the foam members 13, 17 and 30 can be removed from the frame through the openings. As a result, it will be understood that the cover sheet can be completely formed as shown, and the foam members can be subsequently inserted into the cover sheet to complete the rails. This fact allows the frame of the present invention to be shipped in "knocked-down" condition. The cover sheet can therefore be folded into a small package, and the foam members can be stacked compactly, parallel to one another, to minimize the size of the package for shipping.

It was mentioned above that the central portion 26 of the cover sheet holds the rails together and prevents their bowing under the influence of the water pressure exerted by the mattress 11. Since this is true, one cannot use a thin vinyl (e.g. 8 mils) because there would be insufficient strength. One alternative is to use a thicker vinyl (e.g. 20 mils), though this raises the cost. Another alternative is to add an inexpensive sheet of a stronger material, such as a mesh of polyester or the like. It will be understood that woven fabric, non-woven fabric, and open mesh materials may be used, the primary criterion being sufficient strength to prevent stretching of the central portion 26 of the cover sheet. Also, the reinforcing sheet may be integral with the cover sheet if desired, in the form of a scrim reinforced vinyl, or a laminated sheet.

If the reinforcing sheet 31 is a thermoplastic material, it is possible to heat seal the cover sheet and the reinforcing sheet together with one seal; however, it will be understood that waterbed manufacturers typically use radio-frequency (RF) sealing, and many thermoplastic material cannot be sealed by RF. The preferred technique is therefore to utilize a mesh as the reinforcing sheet 31, and to place the sheet 31 between the portion 26 and the portion 22 as shown in FIG. 4 of the drawings. When the vinyl is heated, the vinyl will flow into the openings in the sheet 31 and lock the sheet 31 in place.

To use the arrangement shown in FIG. 4 of the drawings, it will be understood that a mesh material may be used, or a non-mesh may be used, but with holes provided in the edges of the material to allow appropriate flow-through of the soft vinyl. The result is the same, so long as there is sufficient locking of the reinforcing sheet 31. In any case, if there is insufficient vinyl, additional layers of vinyl can be added at the seam. All will be sealed together, and the required amount of vinyl will then be present.

The present invention therefore provides a very simple and economical waterbed frame, the frame having a safety liner integral therewith. The frame can be shipped ready to use, or knocked-down for easier shipping. Since the only assembly required is to insert the foam members into the formed cover sheet, a customer can assemble the frame with no tools. In either case, the ends of the foam members will be held together by the cover sheet so the frame will have a very solid appearance.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. A frame for a waterbed, wherein the waterbed includes a mattress filled with water confined by the frame, said frame comprising a plurality of rails for surrounding and confining said mattress, and means for holding said rails in spaced relationship against the forces exerted by said mattress, each rail of said plurality of rails comprising a foam member, and a cover sheet covering said foam member, said cover sheet being impervious to water and including a first portion beneath said foam member, a second portion extending up outside said frame, a third portion extending across the top of said foam member, a fourth portion extending down inside the frame, and a central portion extending from said fourth portion of one rail to the fourth portion of the opposite rail so that said central portion constitutes said means for holding said rails in spaced relationship, said first portion being sealed to said central portion, a reinforcing sheet substantially coextensive with said central portion of said cover sheet and fixed thereto, said cover sheet consisting of a thermoplastic material, and wherein said reinforcing sheet consists of a mesh material.

2. A frame for a waterbed, wherein the waterbed includes a mattress filled with water confined by the frame, said frame comprising a plurality of rails for surrounding and confining said mattress, and means for holding said rails in spaced relationship against the forces exerted by said mattress, each rail of said plurality of rails comprising a foam member having two ends, and a cover sheet covering said foam member, said cover sheet including a first portion beneath said foam member, a second portion extending up outside said frame, a third portion extending across the top of said foam member, a fourth portion extending down inside the frame, and a central portion extending from said fourth portion of one rail to the fourth portion of an opposite rail so that said central portion constitutes said means for holding said rails in spaced relationship, said first portion being sealed to said central portion, said cover sheet defining a plurality of openings therein in said first portion of said cover sheet, each opening of said plurality of openings being located at the ends of two of said foam members so that such two of said foam members can be selectively inserted and removed through said opening to allow selective removal and replacement of said foam members.

* * * * *